US010450984B2

(12) United States Patent
Hirano

(10) Patent No.: US 10,450,984 B2
(45) Date of Patent: Oct. 22, 2019

(54) CONTROL DEVICE FOR INTERNAL COMBUSTION ENGINE

(71) Applicant: Toyota Jidosha Kabushiki Kaisha, Toyota-shi, Aichi-ken (JP)

(72) Inventor: Takahiro Hirano, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 11 days.

(21) Appl. No.: 15/938,513

(22) Filed: Mar. 28, 2018

(65) Prior Publication Data

US 2018/0291831 A1 Oct. 11, 2018

(30) Foreign Application Priority Data

Apr. 11, 2014 (JP) ..... 2017-078404

(51) Int. Cl.

| | |
|---|---|
| ***F02D 41/22*** | (2006.01) |
| ***F02M 37/00*** | (2006.01) |
| ***F02M 37/04*** | (2006.01) |
| ***F02D 41/38*** | (2006.01) |
| ***F02M 47/00*** | (2006.01) |

(52) U.S. Cl.

CPC ..... *F02D 41/221* (2013.01); *F02D 41/3836* (2013.01); *F02D 41/3845* (2013.01); *F02M 37/0052* (2013.01); *F02M 37/04* (2013.01); *F02M 47/00* (2013.01); *F02D 2041/224* (2013.01); *F02D 2200/0602* (2013.01); *F02D 2200/0606* (2013.01)

(58) Field of Classification Search

CPC ..... F02D 41/221; F02D 41/3845; F02D 2200/0602; F02D 2200/0606; F02D 2041/224; F02M 37/04; F02M 37/0052

See application file for complete search history.

(56) References Cited

U.S. PATENT DOCUMENTS

2003/0183198 A1* 10/2003 Mahr ..... F02M 47/027 123/447

2004/0020465 A1 2/2004 Tanabe et al.

(Continued)

FOREIGN PATENT DOCUMENTS

JP 2004-060561 A 2/2004

JP 2005-248720 A 9/2005

(Continued)

*Primary Examiner* — Xiao En Mo

(74) *Attorney, Agent, or Firm* — Dinsmore & Shohl LLP

(57) ABSTRACT

A control device for an internal combustion engine includes a fuel tank, a high pressure fuel passage, a pressure increasing device, a switching device, a low pressure fuel passage, a temperature sensor, a fuel injector, and an electronic control unit. The electronic control unit is configured to determine that there is an abnormality in the switching device when a temperature measured by the temperature sensor when the pressure increase signal is output is not higher than a temperature measured by the temperature sensor when the pressure increase signal is not output. The electronic control unit is configured to stop fuel pressure increase by the pressure increasing device by stopping an output of the pressure increase signal regardless of the engine operation state when the electronic control unit determines that there is the abnormality in the switching device.

5 Claims, 11 Drawing Sheets

(56) References Cited

U.S. PATENT DOCUMENTS

| | | | | |
|---|---|---|---|---|
| 2004/0134465 | A1* | 7/2004 | Boltz | F02B 1/12 123/446 |
| 2004/0194762 | A1* | 10/2004 | Okamoto | F02D 41/3872 123/458 |
| 2005/0268888 | A1* | 12/2005 | Nakayama | F02D 41/3872 123/446 |
| 2006/0042598 | A1* | 3/2006 | Magel | F02M 47/027 123/446 |
| 2006/0097067 | A1* | 5/2006 | Buehler | F02M 47/027 239/88 |
| 2006/0144367 | A1* | 7/2006 | Futonagane | F02D 41/3836 123/446 |
| 2006/0162695 | A1* | 7/2006 | Shibata | F02M 47/027 123/446 |
| 2006/0196474 | A1* | 9/2006 | Magel | F02M 47/027 123/446 |
| 2007/0089710 | A1* | 4/2007 | Watanabe | F02D 41/221 123/446 |
| 2008/0041977 | A1* | 2/2008 | Hotta | F02M 41/124 239/533.12 |
| 2008/0264383 | A1* | 10/2008 | Omae | F02M 63/0015 123/445 |
| 2008/0265054 | A1* | 10/2008 | Buehler | F02M 47/027 239/88 |
| 2013/0118452 | A1* | 5/2013 | Yoon | F02M 21/0212 123/456 |

FOREIGN PATENT DOCUMENTS

| | | | |
|---|---|---|---|
| JP | 2005-248722 | A | 9/2005 |
| JP | 2007-255306 | A | 10/2007 |

* cited by examiner

CONTROL DEVICE FOR INTERNAL COMBUSTION ENGINE

CROSS-REFERENCE TO RELATED APPLICATIONS

This application claims priority to Japanese Patent Application No. 2017-078404 filed on Apr. 11, 2017, which is incorporated herein by reference in its entirety including the specification, drawings and abstract.

BACKGROUND

1. Technical Field

The present disclosure relates to a control device for m internal combustion engine.

2. Description of Related Art

An internal combustion engine is known in which fuel which is supplied from a common rail, and a pressure of which is further increased by a pressure increasing device, is injected through a fuel injection valve. As the pressure increasing device described above, a pressure increasing device having a pressure increasing piston for supplying fuel from the pressure increasing device and a pressure increase control valve for controlling the pressure of fuel acting on the pressure increasing piston is known. Specifying whether the cause of an abnormality is the pressure increasing device or the fuel injection valve when the abnormality in fuel injection is detected in the internal combustion engine described above is known. For example, Japanese Unexamined Patent Application Publication No. 2005-248722 (JP 2005-248722 A) discloses specifying whether or not there is the abnormality in the fuel injection characteristic by comparing the fuel pressure measured at the fuel injection valve with the fuel pressure obtained by simulation and specifying the cause of the abnormality when there is the abnormality in the fuel injection characteristic.

SUMMARY

Incidentally, by detecting the waveform of the fuel pressure measured in the fuel injection valve, whether the cause of the abnormality m fuel injection is the pressure increasing device or the fuel injection valve can be specified. However, determining whether or not there is an abnormality in a pressure increase control valve in the pressure increasing device has keen difficult. For example, when the pressure increasing device cannot increase the fuel pressure due to an abnormality in the pressure increasing piston and when the pressure increasing device cannot increase the fuel pressure due to an abnormality in the pressure increase control valve, there is a possibility that the waveform of the fuel pressure measured in the fuel injection valve will have a similar shape. In the above cases, specifying whether or not there is an abnormality in the pressure increase control valve by detecting the waveform of the fuel pressure measured at the fuel injection, valve has been difficult.

An aspect of the present disclosure relates to a control device for an internal combustion engine. The control device includes: a fuel tank; a high pressure fuel passage through which fuel flows, the fuel being supplied from the fuel tank and has a pressure increased by a supply pump; a pressure increasing device configured to increase the pressure of fuel supplied from the high pressure fuel passage; a switching device configured to switch a state of connection with the pressure increasing device between a first connection state, in which the pressure increasing device and the high pressure fuel passage are connected to each other, and a second connection state, in which the pressure increasing device and the fuel tank are connected to each other, to drive the pressure increasing device; a low pressure fuel passage through which fuel, which returns to the fuel tank without being increased in pressure by the pressure increasing device, flows when the connection state is switched to the second connection state and the pressure of fuel is increased by the pressure increasing device; a temperature sensor configured to measure a temperature of fuel flowing through the low pressure fuel passage; a fuel injector configured to inject fuel having the pressure increased by the pressure increasing device; and an electronic control unit configured to determine whether or not to increase the pressure of fuel based on an operation state of the internal combustion engine, and the electronic control unit being configured to increase the pressure of fuel by outputting a pressure increase signal for switching the connection state to the second connection state when the electronic control unit determines that the pressure of fuel is to be increased. The electronic control unit is configured to determine that there is an abnormality in the switching device when a temperature measured by the temperature sensor when the pressure increase signal is output is not higher than a temperature measured by the temperature sensor when the pressure increase signal is not output. The electronic control unit is configured to stop fuel pressure increase performed by the pressure increasing device by stopping an output of the pressure increase signal regardless of the operation state of the internal combustion engine when the electronic control unit determines that there is an abnormality in the switching device.

According to the aspect of the present disclosure, whether or not there is an abnormality hi the switching device can be determined.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

First Embodiment

Figure 1:
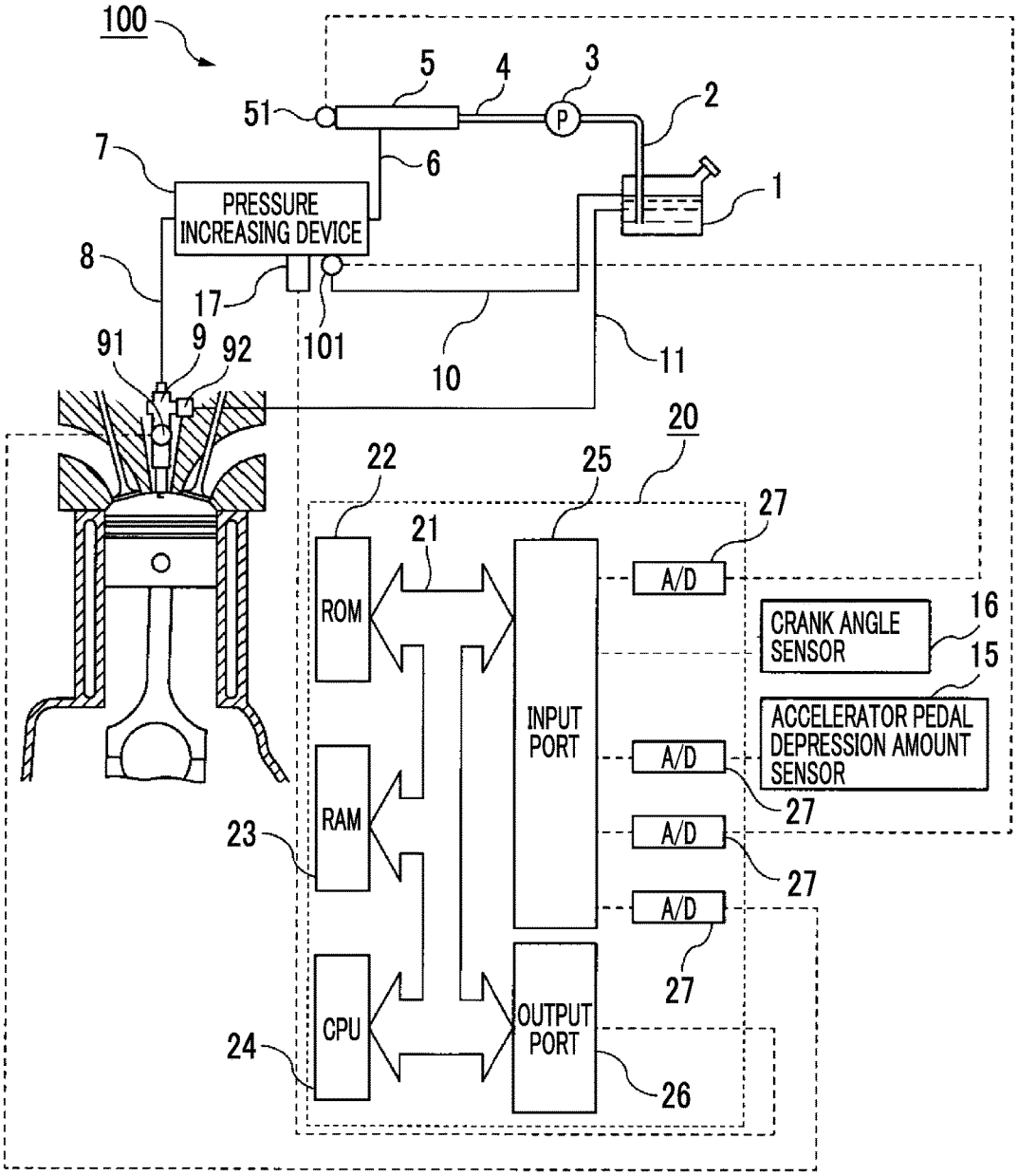
FIG. 1 is a schematic diagram showing an internal combustion engine of a first embodiment of the present disclosure.

FIG. 1 is a schematic configuration diagram of an internal combustion engine 100 according to a first embodiment of the present disclosure and an electronic control unit 20 that controls the internal combustion engine 100.

The internal combustion engine 100 according to the present embodiment includes a fuel tank 1, a pump suction passage 2, a supply pump 3, a pump discharge passage 4, a common rail 5, a supply passage 6, a pressure increasing device 7; an injection passage 8, an injector 9, a return passage 10 and a relief passage 11.

The fuel tank 1 stores fuel supplied from the outside at atmospheric pressure. The fuel stored in the fuel tank 1 is sucked up by the supply pump 3 through the pump suction passage 2.

The supply pump 3 sucks up the fuel stored in the fuel tank 1, and increases the fuel pressure. The fuel having a pressure that has been increased by the supply pump 3 is supplied to the common rail 5 through the pump discharge passage 4. The amount of fuel discharged from the supply pump 3 can be controlled by the electronic control unit 20, and the fuel pressure in the common rail 5 is controlled by controlling the amount of fuel discharged from the supply pump 3.

The common rail 5 holds the fuel, which is supplied from the supply pump 3 through the pump discharge passage 4, in a high pressure state. The common rail 5 is connected to a plurality of supply passages 6 corresponding to respective cylinders, and distributes fuel to each cylinder. The common rail 5 includes a common rail pressure sensor 51 for measuring the pressure of fuel held in the common rail 5. In the following description, the fuel pressure in the common rail 5 will be referred to as a common rail pressure Pcr.

The pressure increasing device 7 is provided corresponding to each cylinder, and further increases the pressure of fuel supplied from the common rail 5 through the supply passage 6 and supplies the fuel to the injector 9 through the injection passage 8. An actuator 17 for driving the pressure increasing device 7 is provided in the pressure increasing device 7. When a signal is transmitted from the electronic control unit 20 (which will be described later) to the actuator 17, the actuator 17 is driven so that the pressure increasing device 7 increases the fuel pressure. As the pressure increasing device 7 discharges the fuel having an increased pressure toward the injector 9, the pressure increasing device 7 discharges fuel having a pressure that has not been increased to the fuel tank 1 through the return passage 10. A return passage temperature sensor 101 for defecting the temperature of fuel flowing through the return passage 10 is provided in the return passage 10.

The injector 9 is provided corresponding to each cylinder, and injects the fuel supplied from the pressure increasing device 7 through the injection passage 8 to the cylinder. The amount of fuel injected into the cylinder (fuel injection amount) increases as the pressure of fuel supplied to the injector 9 increases in a case where the valve opening time of the injector 9 is the same. Therefore, in the present embodiment, in order to control the fuel injection amount, the pressure of fuel supplied to the injector 9 is controlled. For this reason, an injection pressure sensor 91 for measuring the pressure of fuel supplied to the injector 9 is provided in the injector 9. In the following description, the fuel pressure in the injector 9 will be referred to as a fuel injection pressure Pinj.

In addition, a relief valve 92 for returning the fuel to the fuel tank 1 through the relief passage 11 in a case where the fuel pressure becomes too high is provided in the injector 9. The relief valve 92 is provided between the inside of the injector 9 and the relief passage 11 and is opened in a case where the fuel pressure of the injector 9 becomes higher than the predetermined fuel pressure, so that the fuel in the injector 9 is discharged toward the fuel tank 1.

The electronic control unit 20 is a digital computer, and includes a ROM 22, a RAM 23, a CPU 24, an input port 25, and an output port 26 that are connected to each other by a bidirectional bus 21.

Analog signals from the common rail pressure sensor 51, the injection pressure sensor 91, and the like are input, to the input port 25 after being converted into digital signals through corresponding AD converters 27. An analog signal from an accelerator pedal depression amount sensor 15 that detects the depression amount of an accelerator pedal in order to detect the load of the internal combustion engine 100 is input to the input port 25 after being converted into a digital signal through the AD converter 27. A digital signal output from a crank angle sensor 16 for detecting the rotation speed of the crankshaft is input to the input port 25. As described above, output signals of various sensors needed to control the internal combustion engine 100 are input to the input port 25. The output port 26 is connected to the supply pump the pressure increasing device 7, the injector 9, and the like, and outputs a digital signal calculated by the CPU 24.

Figure 2A:
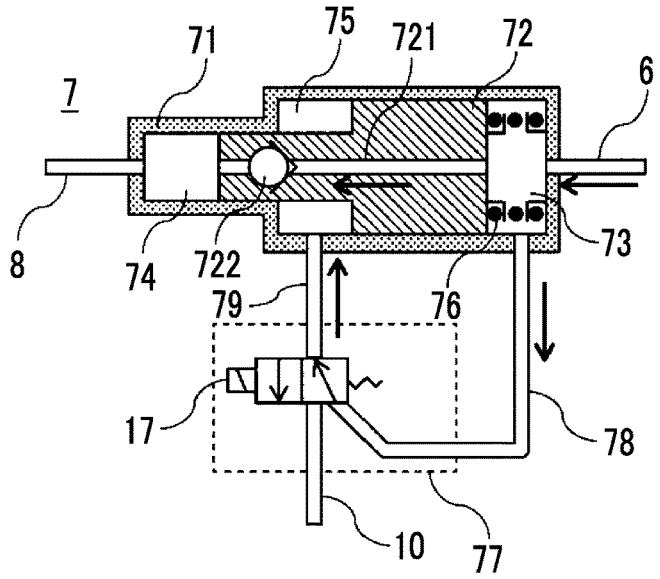
FIG. 2A is a schematic diagram showing the state of a pressure increasing device before pressure increase.
Figure 2B:
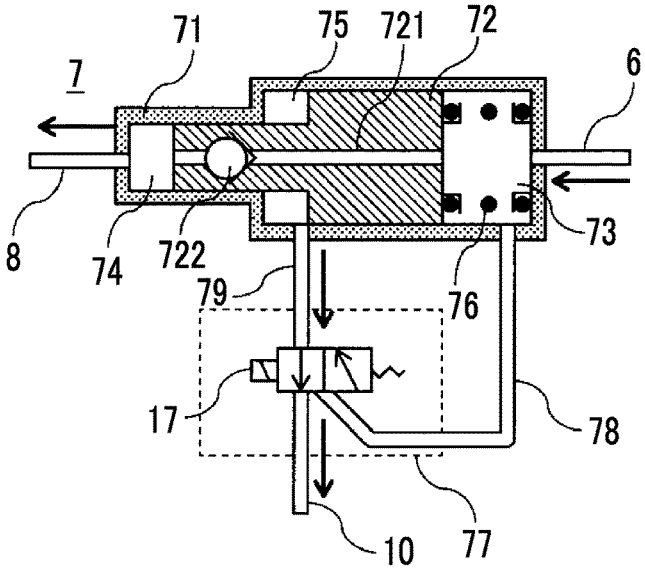
FIG. 2B is a schematic diagram showing the state of the pressure increasing device after pressure increase.

The configuration of the pressure increasing device 7 will be described with reference to FIGS. 2A and 2B. FIG. 2A is a schematic diagram showing the state of the pressure increasing device 7 before the fuel pressure is increased by the pressure increasing device 7. FIG. 2B is a schematic diagram showing a state in which the pressure increasing device 7 increases the pressure of fuel and discharges the fuel toward the injector 9.

As shown in FIG. 2A, the pressure increasing device 7 includes a housing 71, a piston 72, a piston chamber 73, a pressure increasing chamber 74, a pressure increase control chamber 75, a spring 76, a three-way valve 77, a first three-way valve passage 78, and a second three-way valve passage 79. The arrows in FIGS. 2A and 2B indicate a direction in which fuel flows.

The inside of the housing 71 is filled with fuel. In the present embodiment, the supply passage 6 is connected to a first end (right side in the diagram) of the housing 71 in the longitudinal direction and the injection passage 8 is connected to a second end (left side in the diagram) of the housing 71, and the fuel supplied to the inside of the housing 71 through the supply passage 6 is discharged from the injection passage 8. In the following description, the right side of FIG. 2A or 2B will be referred to as a supply passage 6 side, and the left side of FIG. 2A or 2B will be referred to as an injection passage 8 side. The housing 71 has a shape obtained by connecting two cylinders having different inner diameters, and the inner diameter of the cylinder on the supply passage 6 side is larger than the inner diameter of the cylinder on the injection passage 8 side. Hereinafter, the cylinder on the supply passage 6 side will be referred to as a "large diameter portion of the housing 71", the inner peripheral surface of the large diameter portion of the housing 71 will be referred to as a "large diameter inner peripheral surface of the housing 71", the cylinder on the injection passage 8 side will be referred to as a "small diameter portion of the housing 71", and the inner peripheral surface of the small diameter portion of the housing 71 will be referred to as a "small diameter inner peripheral surface of the housing 71".

The piston 72 is housed in the housing 71 so as to be movable in the housing 71 along the longitudinal direction of the housing 71.

The piston 72 has a shape obtained by connecting two cylinders having different diameters, and the diameter of the cylinder on the supply passage 6 side is larger than the diameter of the cylinder on the injection passage 8 side. Hereinafter, the cylinder on the supply passage 6 side will be referred to as a "large diameter portion of the piston 72", the outer peripheral surface of the large diameter portion of the piston 72 will be referred to as a "large diameter outer peripheral surface of the piston 72", the cylinder on the injection passage 8 side will be referred to as a "small diameter portion of the piston 72", and the outer peripheral surface of the small diameter portion of fee piston 72 will be referred to as a "small diameter outer peripheral surface of the piston 72".

The piston chamber 73 disposed on the supply passage 6 side, the pressure increasing chamber 74 disposed on the injection passage 8 side, and the pressure increase control chamber 75 disposed between the piston chamber 73 and the pressure increasing chamber 74 are formed Inside the housing 71 by the piston 72 and the housing 71.

The piston 72 includes a piston inner passage 721 provided so as to pass through the piston 72 in the longitudinal direction and a check valve 722 provided in the piston inner passage 721. The check valve 722 allows fuel to flow into the piston inner passage 721 toward the pressure increasing chamber 74 from the piston chamber 73, and restricts the flow of fuel from the pressure increasing chamber 74 toward the piston chamber 73 through the piston inner passage 721.

The piston chamber 73 is a space formed by the end surface of the large diameter portion of the housing 71, the large diameter inner peripheral surface of the housing 71, and the end surface of the large diameter portion of the piston 72. The piston chamber 73 is filled with high pressure fuel that is supplied from the common rail 5 through the supply passage 6. The spring 76 extending and contracting in the longitudinal direction of the housing 71 is provided in a piston chamber 73, and the spring 76 pulls the piston 72 toward the supply passage 6.

The pressure increasing chamber 74 is a space formed by the small diameter inner peripheral surface of the housing 71, the end surface of the small diameter portion of the housing 71, and the end surface of the small diameter portion of the piston 72. The pressure increasing chamber 74 is connected to the piston chamber 73 through the piston inner passage 721, so that the fuel in the piston chamber 73 is supplied to the pressure increasing chamber 74. The pressure increasing chamber 74 is also connected to the injection passage 8.

The pressure increase control chamber 75 is provided between the piston chamber 73 and the pressure increasing chamber 74, and is a space defined by the large diameter inner peripheral surface of the housing 71 and the small diameter outer peripheral surface of the piston 72.

The pressure increase control chamber 75 is selectively connected to the common rail 5 or the fuel tank 1. The pressure increase control chamber 75 and the common rail 5 do not necessarily need to be directly connected to each other, and the pressure increase control chamber 75 and the common rail 5 are defined as being connected to each other as long as the fuel in the common rail 5 is supplied to the pressure increase control chamber 75. A case where the pressure increase control chamber 75 and the fuel tank 1 are connected to each other are also defined similarly. In the present, embodiment, the pressure increase control chamber 75 is connected to the common rail 5 through the second three-way valve passage 79, the first three-way valve passage 78, the piston chamber 73, and the supply passage 6, and the pressure increase control chamber 75 is connected to the fuel tank 1 through the second three-way valve passage 79 and the return passage 10.

As shown in FIG. 2A, when the pressure increase control chamber 75 is connected to the common rail 5, the high pressure fuel from the common rail 5 is supplied to the pressure increase control chamber 75. On the other hand, as shown in FIG. 2B, when the pressure increase control chamber 75 is connected to the fuel tank 1, the fuel in the pressure increase control chamber 75 is discharged to the fuel tank 1, and the fuel pressure in the pressure increase control chamber 75 is reduced.

In the present embodiment, the three-way valve 77 is a spool type solenoid valve. By driving the three-way valve 77 with the actuator 17 provided in the three-way valve 77, the pressure increasing device 7 is switched between a state in which the pressure increase control chamber 75 and the common rail 5 are connected to each other (FIG. 2A) and a state in which the pressure increase control chamber 75 and the fuel tank 1 are connected to each other (FIG. 2B). The actuator 17 is controlled by the signal output from the electronic control unit 20.

Figure 3A:
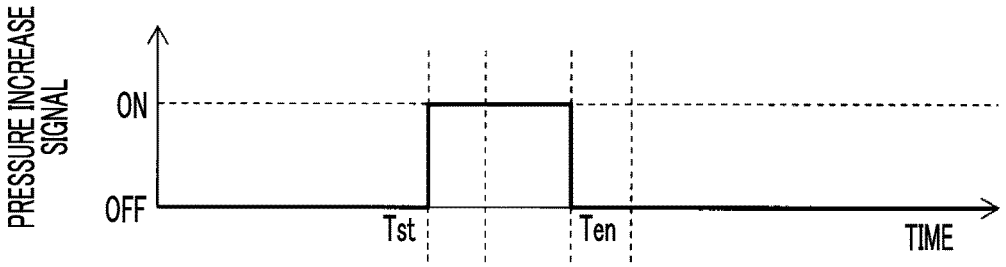
FIG. 3A is a timing chart showing a temporal change of a pressure increase signal that an electronic control unit outputs to the pressure increasing device.
Figure 3B:
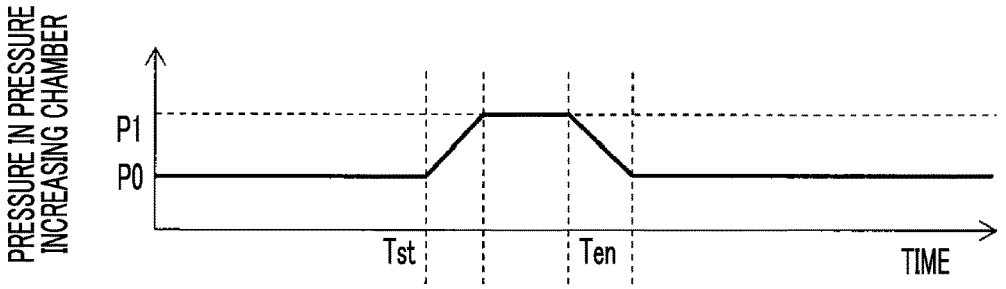
FIG. 3B is a timing chart showing a temporal change in the pressure of fuel discharged from a pressure increasing chamber in the pressure increasing device.

The operation of the pressure increasing device 7 will be described with reference to FIGS. 2A to 3B. FIG. 3A is a timing chart showing a temporal change of a signal transmitted from the electronic control unit 20 to the pressure increasing device 7, and FIG. 3B is a timing chart showing a temporal change in the pressure of fuel discharged from the pressure increasing device 7 toward the injector 9.

First, in the initial state (state before time Tst), as shown in FIG. 2A, the three-way valve 77 connects the common rail 5 and the pressure increase control chamber 75 to each other through the supply passage 6. At this time, high pressure fuel is supplied from the common rail 5 to the piston chamber 73 and the pressure increase control chamber 75. As a result, the fuel pressure of the piston chamber 73 and the fuel pressure of the pressure increase control chamber 75 are balanced. However since the piston 72 is pulled toward the supply passage 6 by the spring 76 disposed m the piston chamber 73, the piston 72 is disposed on the supply passage 6 side.

Then, at time Tst, the electronic control unit 20 switches a pressure increase signal, which is a signal for driving the pressure increasing device 7, from OFF to ON to drive the actuator 17. When the pressure increase signal is turned on, the pressure increase control chamber 75 is connected to the fuel tank 1 through the return passage 10. Accordingly the fuel in the pressure increase control chamber 75 is discharged to the fuel tank 1, and the fuel pressure hi the pressure increase control chamber 75 is reduced. As a result, the fuel pressure in the piston chamber 73 becomes higher than the fuel pressure in the pressure increase control chamber 75, so that the fuel filled in the piston chamber 73 applies a force in a direction in which the piston 72 is pushed toward the injection passage 8 side and the piston 72 starts to move toward the injection passage 8 side.

As shown in FIG. 2B, when the piston 72 starts to move to the injection passage 8 side, the volume of the pressure increasing chamber 74 is reduced and the fuel filled in the pressure increasing chamber 74 is discharged to the injection passage 8. Since the sectional area S0 of the large diameter portion of the piston 72 is larger than the sectional area S1 of the small diameter portion of the piston 72, the fuel pressure P1 of the pressure increasing chamber 74 is increased to S0/S1 times the fuel pressure P0 of the piston chamber 73 based on the Pascal's principle. In the following description, the ratio S0/S1 of the fuel pressure will be referred to as a pressure increase ratio R. For example, in the present embodiment, the pressure increase ratio R is 2. Since the check valve 722 is provided in the piston inner passage 721, fuel hardly flows back to the piston chamber 73 as the pressure increasing chamber 74 contracts.

Incidentally, the pressure of fuel discharged to the injection passage 8 is not multiplied by R when the piston 72 starts to move to the injection passage 8 side, and the pressure of fuel discharged to the injection passage 8 gradually increases with the passage of time. That is, the piston 72 gradually accelerates with the passage of time after the piston 72 starts to move to the injection passage 8 side, and the pressure of fuel discharged front the injection passage 8 increases with the acceleration of the piston 72. After a while, the acceleration of the piston 72 ends, and the piston 72 moves at a constant speed toward the injection passage 8. The pressure of fuel discharged from the injection passage 8 while the piston 72 is moving at a constant speed as described above becomes R times the pressure of fuel supplied to the piston chamber 73. The piston 72 moves from the state of FIG. 2A to the state of FIG. 2B in a period from time Tst to time Ten at which the pressure increase signal is switched to OFF.

Then, at time Ten, the electronic control unit 20 switches the pressure increase signal from ON to OFF to stop the supply of power to the actuator 17. After time Ten, since the pressure increase control chamber 75 is connected to the common rail 5 through the piston chamber 73, high pressure fuel is supplied from the common rail 5 to the pressure increase control chamber 75, and the fuel pressure of the pressure increase control chamber 75 is increased. As a result, the force with which the piston 72 pushes out the fuel in the pressure increasing chamber 74 becomes weak, and the pressure of fuel discharged from the pressure increasing chamber 74 decreases with the passage of time. When a certain period of time has passed from time Ten, the deceleration of the piston 72 ends, and the movement toward the injection passage 8 side disappears. As a result, the increase in the fuel pressure in the pressure increasing chamber 74 ends. The pressure of fuel discharged from the bisection passage 8 when the movement of the piston 72 ends becomes equal to the pressure of fuel supplied to the piston chamber 73, that is, the fuel pressure in the common rail 5. When the piston 72 ends the movement toward the injection passage 8 side, the piston 72 becomes closest to the injection passage 8. Accordingly the pressure increasing device 7 is in the state shown in FIG. 2B.

When a predetermined amount of time elapses after the piston 72 ends the movement toward the injection passage 8 side, the piston 72 is moved to the supply passage 6 side since the spring 76 provided in the piston chamber 73 pulls the piston 72 toward the supply passage 6, and finally the pressure increasing device 7 returns to the initial state shown in FIG. 2A. While the piston 72 is moving to the supply passage 6 side, the volume of the pressure increasing chamber 74 increases, and fuel is supplied again from the piston chamber 73 to the pressure increasing chamber 74 through the piston inner passage 721. As described above, the fuel injection pressure can be increased by driving the pressure increasing device 7, that is, reciprocating the piston 72 at each fuel injection timing.

Figure 4A:
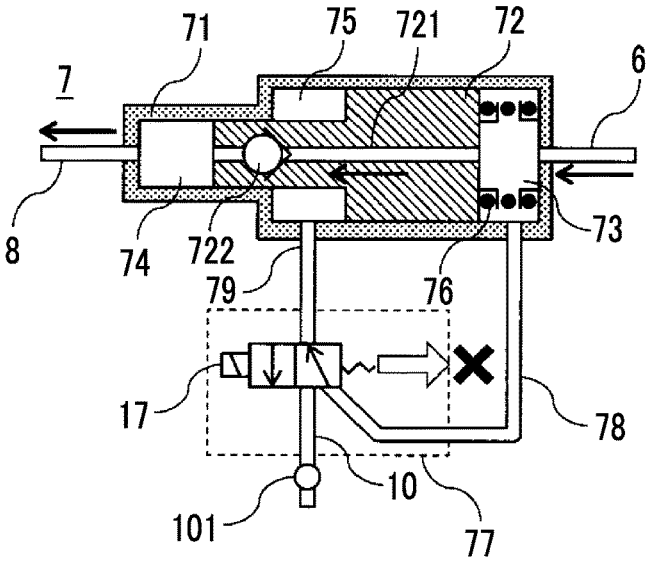
FIG. 4A is a schematic diagram showing the state of the pressure increasing device in a case where there is an abnormality in a three-way valve and the three-way valve does net respond in a state in which a pressure increase control chamber and a common rail are connected to each other.
Figure 4B:
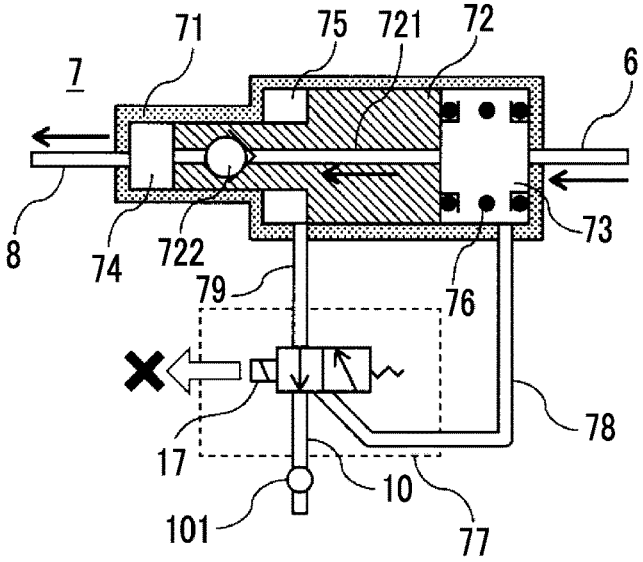
FIG. 4B is a schematic diagram showing the state of the pressure increasing device in a case where there is an abnormality in a three-way valve and the three-way valve does not respond in a state in which a pressure increase control chamber and a fuel tank are connected to each other.
Figure 5:
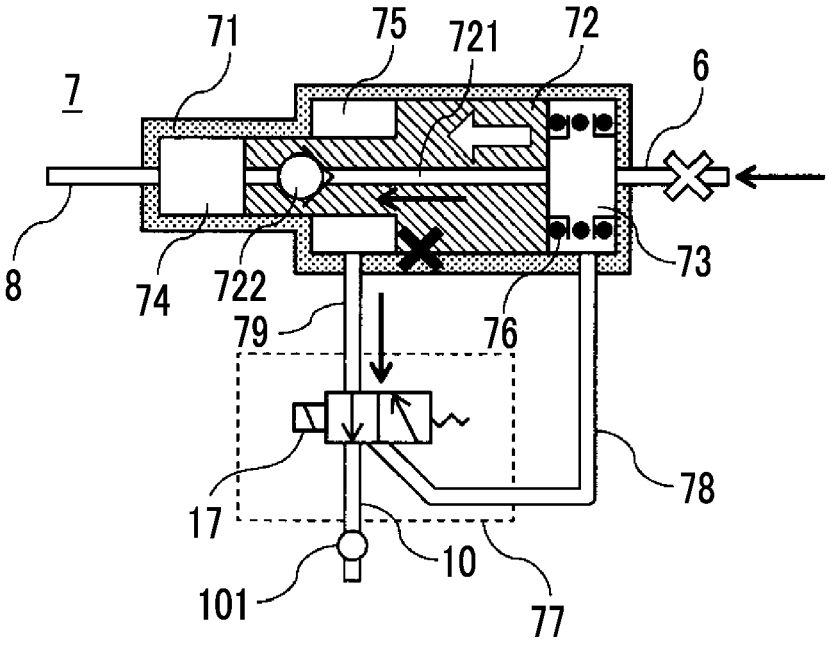
FIG. 5 is a schematic diagram showing the state of the pressure increasing device in a case where there is an abnormality in a piston.

The operation of the pressure increasing device 7 in a case where there is an abnormality in the pressure increasing device 7 will be described with reference to FIGS. 4A to 5. First, the operation of the pressure increasing device 7 in a case where there is an abnormality in the three-way valve 77 will be described with reference to FIGS. 4A and 4B. FIGS. 4A and 4B are schematic diagrams showing the operation of the pressure increasing device 7 in a case where there is an abnormality in the three-way valve 77. In the present embodiment, the case where there is an abnormality in the three-way valve 77 is, for example, a case where the three-way valve 77 does not respond to the pressure increase signal due to an abnormality in the actuator 17. There are two cases in which the three-way valve 11 does not respond.

The first case is a case where the three-way valve 77 does not respond in a state in which the common rail 5 and the pressure increase control chamber 15 are connected to each other as shown in FIG. 4A. In this case, when the electronic control unit 20 switches the pressure increase signal from OFF to ON, the fuel in the pressure increase control chamber 75 is not discharged to the return passage 10. However, since fuel is continuously supplied to the pressure increase control chamber 75 from the common rail 5, a state in which the piston 72 is disposed on the supply passage 6 side is maintained. Since the fuel pressure is increased while the piston 72 is moving toward the injection passage 8, the pressure increasing device 7 cannot increase the fuel pressure when the piston 72 is held on the supply passage 6 side due to an abnormality in the three-way valve.

The second case is a case where the three-way valve 77 does not respond in a state in which the fuel tank 1 and the pressure increase control chamber 75 are connected to each other as shown in FIG. 4B. In this case, when the electronic control unit 20 switches the pressure increase signal from ON to OFF, fuel is not supplied from the common rail 5 after the fuel in the pressure increase control chamber 75 is discharged to the return passage 10. Therefore, since the fuel pressure in the pressure increase control chamber 75 is lower than the fuel pressure in the piston chamber 73 regardless of whether the pressure increase signal is ON or OFF, a state in winch the piston 72 is disposed on the injection passage 8 side is maintained. That is, since the piston 72 cannot move, the pressure increasing device 7 cannot increase the fuel pressure.

To summarize the above, in a case where there is art abnormality in the three-way valve 77 and accordingly the three-way valve 77 does not respond to the pressure increase signal, the piston 72 cannot move. Therefore, the pressure increasing device 7 cannot increase the fuel pressure.

Incidentally, even in a case where there is an abnormality in the three-way valve 77 and accordingly the piston 72 does not move, the fuel supplied from the common rail 5 through the supply passage 6 is supplied to the injection passage 8 through piston inner passage 721 and reaches the injector 9 as shown by black arrow in FIGS. 4A and 4B. Therefore, the fuel injection can be continued. That is, in a case where there is an abnormality in the three-way valve 77, the fuel pressure cannot be increased by the pressure increasing device 7. However, fuel can be injected while stopping the fuel pressure increase.

As an example in which there is an abnormality in a portion of the pressure increasing device 7 other than the three-way valve 11, the operation of the pressure increasing, device 7 in a case where there is an abnormality in the piston 72 will be described with reference to FIG. 5. FIG. 5 is a schematic diagram showing the operation of the pressure increasing device 7 in a case where there is an abnormality in the piston 72. In the present embodiment, the case where there is an abnormality in the piston 72 is, for example, a case where foreign matter adheres (x mark in FIG. 5) between the piston 72 and the housing 71 and the piston 72 does not move. In the above case, since the pressure increase control chamber 75 and the return passage 10 are connected to each other by the three-way valve 77, the fuel in the pressure increase control chamber 75 is discharged, and a pressure difference occurs between the fuel in the piston chamber 73 and the fuel in the pressure increase control chamber 75. However, when foreign matter adheres between the housing 71 and the piston 72, the frictional force between the housing 71 and the piston 72 becomes high, so that the piston 72 does not move. For this reason, the pressure increasing device 7 cannot increase the fuel pressure.

Incidentally, when foreign matter adheres between the housing 71 and the piston 72, the foreign matter caught between the piston 72 and the housing 71 may flow toward the injector 9 due to continuous supply of the fuel to the injector 9 through the pressure increasing device 7, which may adversely affect the injector 9. Therefore, in a case where there is an abnormality in the piston 72, stopping the supply of fuel to the injector 9 by stopping the fuel injection is desirable.

As described above, fuel injection is possible in a case where there is an abnormality in the three-way valve 77, but stopping the fuel injection is desirable in a case where there is an abnormality in a portion of the pressure increasing device 7 other than the three-way valve 77. Therefore, when the electronic control unit 20 cannot determine Whether or not there is an abnormality in the three-way valve 77, the fuel injection is stopped on condition that there is an abnormality in the pressure increasing device 7. However, in the case of using the above control, even though the fuel injection does not need to be stopped in a case where there is an abnormality solely in the three-way valve 77, the fuel injection is stopped by regarding that there is an abnormality in the pressure increasing device 7. Therefore, when the electronic control unit 20 determines that, there is an abnormality in the pressure increasing device 7, performing more accurate control by determining whether or not there is an abnormality in the three-way valve 77 is needed.

As a method of determining whether or not there is an abnormality in the three-way valve 77, a method of measuring the pressure of fuel discharged from the pressure increasing device 7 can be mentioned. However, in the above-described example, in both the case where there is an abnormality in the three-way valve 77 and the case where there is an abnormality in the piston 72, the fuel pressure cannot be increased. For this reason, in both the cases, the pressure of fuel discharged from the pressure increasing device 7 becomes the pressure of the common rail 5. Therefore, determining whether or not there is an abnormality in the three-way valve 77 by detecting the pressure of fuel discharged from the pressure increasing device 7 has been difficult.

In the present embodiment, when the electronic control unit 20 switches the pressure increase signal from OFF to ON, the temperature of the fuel flowing to the return passage 10 is measured by the return passage temperature sensor 101, and the electronic control unit 20 determines that there is an abnormality in the three-way valve 11 in a case where the return passage temperature sensor 101 does not detect that the temperature of the fuel flowing to the return passage 10 has risen.

Hereinafter, the abnormality determination method in the present embodiment will be described in more detail. As described above, there are two cases where there is an abnormality in the three-way valve 77. That is, there are a case where the three-way valve 77 stops moving in a state in which the pressure increase control chamber 75 and the common rail 5 are connected to each other and a case where the three-way valve 77 stops moving in a state in which the pressure increase control chamber 75 and the return passage 10 are connected to each other.

In a case where the state in which the pressure increase control chamber 75 and the common rail 5 are connected to each other is maintained, the pressure increase control chamber 75 and the return passage 10 are not connected to each other. Accordingly, when the electronic control unit 20 switches the pressure increase signal from OFF to ON, no fuel flows to the return passage 10. On the other hand, in a case where the state in which the pressure increase control chamber 75 and the return passage 10 are connected to each other is maintained, a state in which the fuel in the pressure increase control chamber 75 is discharged to the fuel tank 1 through the return passage 10 is maintained. Therefore, even if the electronic control unit 20 switches the pressure increase signal from ON to OFF, the pressure increase control chamber 75 and the common rail 5 are not connected to each other. That is, no fuel is supplied from the common rail 5 to the pressure increase control chamber 75 while the pressure increase signal is OFF. Therefore, when the electronic control unit 20 switches the pressure increase signal from OFF to ON, no fuel remains in the pressure increase control chamber 73. As a result, no fuel flows to the return passage 10.

To summarize the above, in a case where there is an abnormality in the three-way valve 77, even when the electronic control unit 20 switches the pressure increase signal from OFF to ON, no fuel flows to the return passage 10.

On the other hand, in a case where the three-way valve 77 is normal, even if the piston 72 does not move, fuel is supplied to the pressure increase control chamber 75 when the pressure increase signal is switched from OFF to ON, and fuel in the pressure increase control chamber 75 is discharged to the return passage 10 when the pressure increase signal is switched from ON to OFF. That is, when the three-way valve 77 is normal, fuel flows to the return passage 10 when the electronic control unit 20 switches the pressure increase signal from OFF to ON. Accordingly, when the pressure increase signal is switched from OFF to ON, whether or not there is an abnormality in the three-way valve 77 can be determined by determining whether or not fuel flows to the return passage 10.

Incidentally, in the present embodiment, whether or not fuel flows to the return passage 10 is determined based on whether or not the temperature of the fuel flowing to the return passage 10 has risen. In the present embodiment, the return passage temperature sensor 101 for measuring the temperature of fuel flowing through the return passage 10 is provided in the return passage 10, and the temperature of the fuel flowing through the return passage 10 is measured based on the value of the retain passage temperature sensor 101.

The reason why the temperature of the fuel flowing through the return passage 10 rises when the fuel, flows to the return passage 10 will be described. As described above, while the three-way valve 77 is normally moving, the fuel in the pressure increase control chamber 75 is discharged to the return passage 10. The fuel pressure in the pressure increase control chamber 75 is equal to the fuel pressure in the common rail 5. Therefore, when the fuel in the pressure increase control, chamber 75 is discharged to the return passage 10, the fuel pressure does not decrease, and the temperature of the fuel rises since the energy held as the pressure is converted to the temperature. When the fuel flows from the pressure increase control chamber 75 to the return passage 10 through the second three-way valve passage 79, heat is generated due to the resistance between the wall surface of the second three-way valve passage 79 and the fuel when the fuel passes through the second three-way valve passage 79. As a result, the temperature of the fuel rises. As described above, when the three-way valve 77 normally functions, the fuel in the pressure increase control chamber 75 is discharged to the return passage 10. At this time, since the temperature of the fuel rises, whether or not the three-way valve 77 normally functions, can be determined by detecting a rise in the temperature of the fuel flowing through the return passage 10.

In the present embodiment, the temperature of fuel flowing through the return passage 10 is detected using the return passage temperature sensor 101 provided in the return passage 10. However, instead of the temperature of the fuel flowing through the return passage 10, the temperature of the fuel flowing through the second three-way valve passage 79 when the pressure increase signal is switched from OFF to ON may be detected.

Meanwhile, since the performance of the three-way valve 77 may be lowered when the temperature is too high, a temperature sensor for pleasuring the temperature of the three-way valve 77 may be provided in the pressure increasing device 7. In the present embodiment, the temperature of the three-way valve 77 is estimated based on the value measured by the return passage temperature sensor 101. Therefore, in the present embodiment, since there is no need to separately provide a sensor for measuring the temperature of the three-way valve 77 and a sensor for measuring the return passage temperature sensor 101, the number of sensors can be reduced.

Hereinafter, a routine for detecting an abnormality in the three-way valve 77 in the present embodiment will be described. The routine of the present embodiment includes a routine relevant to fuel injection described in FIG. 6, a routine relevant to fuel injection setting described in FIG. 7, and a routine relevant to abnormality detection described in FIG. 9.

Figure 6:
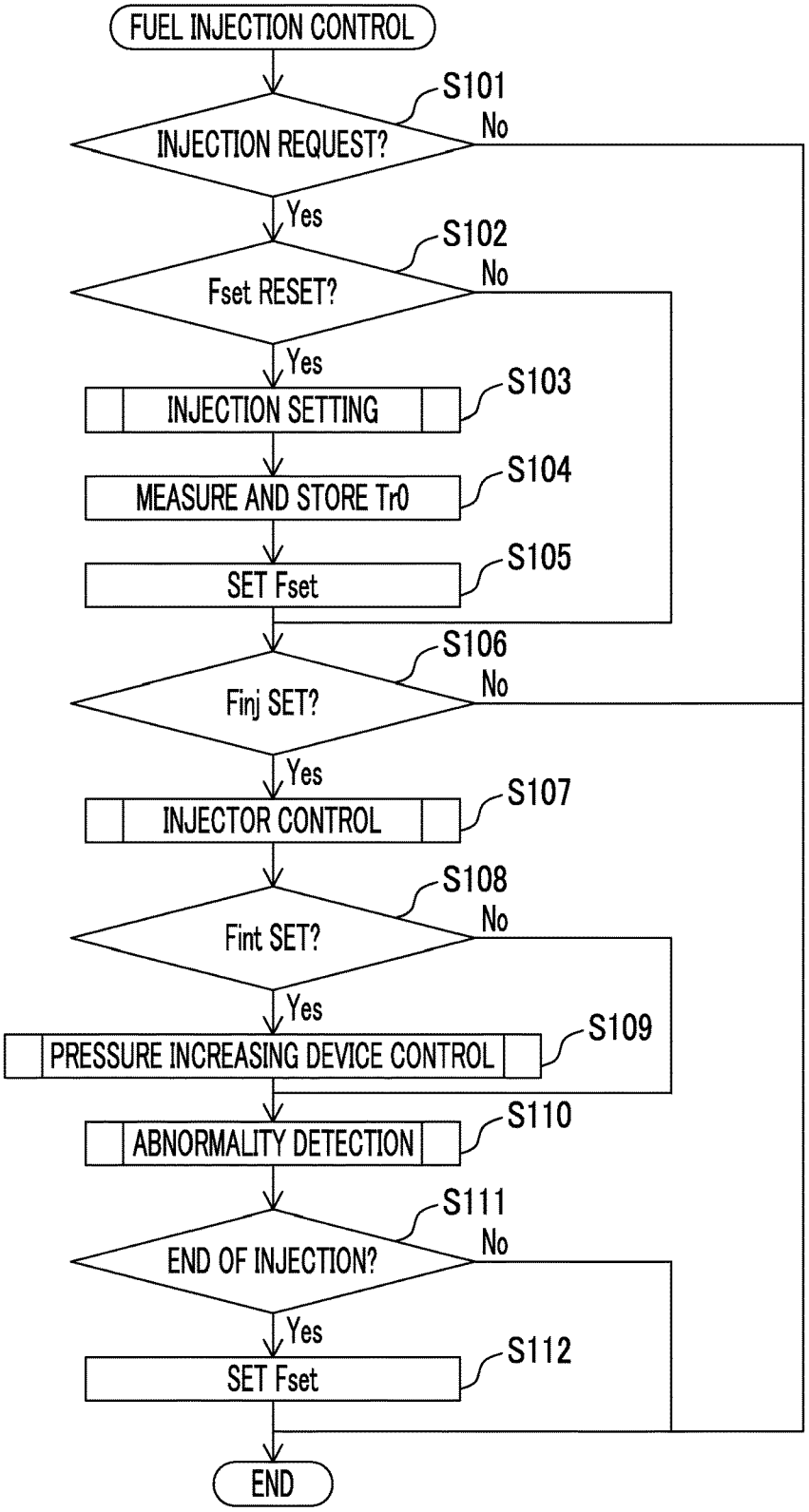
FIG. 6 is a flowchart showing a routine for performing fuel injection in the first embodiment and a second embodiment of the present disclosure.

FIG. 6 is a flowchart showing a routine relevant to the control of fuel injection in the present embodiment. This routine is periodically executed at fixed periods.

In step S101 the electronic control unit 20 determines whether or not there is a request for fuel injection. When there is an injection request, the process proceeds to step S102 to perform fuel injection. When there is no injection request, the electronic control unit 20 ends this routine without performing fuel injection.

In step S102, the electronic control unit 20 determines whether or not an injection setting flag Fset, which is set in a case where the setting of fuel injection is performed, is reset. In a case where the injection setting flag Fset is set, the process proceeds to step S106 since the setting of fuel injection is not needed. In a case where the injection setting flag Fset is reset, the process proceeds to step S103 since the setting of fuel injection is needed. The initial state of the injection setting flag Fset is a reset state, In step S103, the electronic control unit 20 performs injection setting processing for setting fuel injection. That is, in order to inject the fuel, the movement of the pressure increasing device 7 or the injector 9 is set based on whether or not there is an abnormality in the pressure increasing device 7 or the injector 9. Details of the injection setting processing will be described later with reference to the flowchart shown in FIG. 7. In step S103, an injection permission flag Finj is set in a case where the electronic control unit 20 determines that fuel injection may be performed, and a pressure increase permission flag Fint is set in a case where the electronic control unit 20 determines that the fuel pressure, may be increased. When the processing of step S103 is ended, the electronic control unit 20 proceeds to step S104. The setting of fuel injection in step S103 is performed just once each time fuel injection is performed.

In step S104, the electronic control unit 20 measures the temperature of the fuel flowing through the return passage 10 using the return passage temperature sensor 101, and stores the temperature of the fuel flowing through the return passage 10. Step S104 is executed before fuel is injected. Hereinafter, the temperature stored in step S104 will be referred to as "pre-injection return temperature Tr0".

In step S105, the electronic control unit 20 sets the injection setting flag Fset that is set when the fuel injection setting ends. Since the injection setting flag Fset is set, the fuel injection is not set again until the fuel injection ends.

In step S106, the electronic control unit 20 determines whether or not the injection permission flag Finj, which is set in a case where the injection of fuel by the injector 9 is allowed, is set. In a case where the injection permission flag Finj is set, the electronic control unit 20 proceeds to step S107 to inject fuel. In a case where the injection permission flag Finj is not set, the electronic control unit 20 ends this routine without injecting fuel. The initial state of the injection permission flag Finj is a set state. In the present embodiment, once the injection permission flag Finj is set to the reset state, the fuel injection by the injector 9 is continuously stopped without returning to the set state until the injector 9 is repaired.

In step S107, the electronic control unit 20 controls the injector 9 to inject fuel. That is, when the crank angle obtained from the crank angle sensor 16 reaches that at the time set in step S103, the electronic control unit 28 controls the fuel injection by switching the injection signal. In step S107, the electronic control unit 20 controls not only the injector 9 but also the supply pump 3. That is, the electronic control unit 20 controls the common rail pressure Per by controlling the supply pump 3 such that the common rail pressure Per set in step S103 is obtained.

In step S108, the electronic control unit 20 determines whether or not the pressure increase permission flag Fint, which is set in a case where the fuel pressure increase by the pressure increasing device 7 is allowed, is set. In a case where the electronic control unit 20 determines that the pressure increase permission flag Fint is set, the process proceeds to step S109 to increase the fuel pressure, in a case where the electronic control unit 20 determines that the pressure increase permission flag Fint is set, the process proceeds to step S110 to determine whether or not there is an abnormality in fuel injection. The initial state of the pressure increase permission flag Fint is a set state.

In step S109, the electronic control unit 20 controls the pressure increasing device 7 to increase the fuel pressure. When the crank angle measured by the crank angle sensor 16 reaches that at the time set in step S103, the electronic control unit 20 increases the fuel pressure by switching, the pressure increase signal from OFF to ON. When stopping the fuel pressure increase by the pressure increasing device 7, the electronic control unit 20 switches the pressure increase signal from ON to OFF in step S109.

In step S110, the electronic control unit 20 performs abnormality detection processing. The abnormality detection processing is processing for determining whether or not there are abnormalities in the pressure increasing device 7 and the injector 9 allowing fuel pressure increase based on the abnormalities in the pressure increasing device 7 and the injector 9 in order to allow fuel injection. Details of the abnormality detection processing will be described later with reference to the flowchart shown in FIG. 9. When the processing of step S110 is ended, the electronic control unit 20 proceeds to step S111.

In step S111, the electronic control unit 20 determines whether or not the fuel injection has ended. In a case where the electronic control unit 20 determines that the fuel injection has ended, the process proceeds to step S112 to set the injection setting flag Fset. In a case where the electronic control unit 20 determines that the fuel injection has not ended, the electronic control unit 20 ends tire processing of this routine. In the present embodiment, whether or not the fuel injection has ended is determined based on whether or not the crank angle measured by the crank angle sensor 16 is larger than that at the end time of the fuel injection set in advance.

Figure 7:
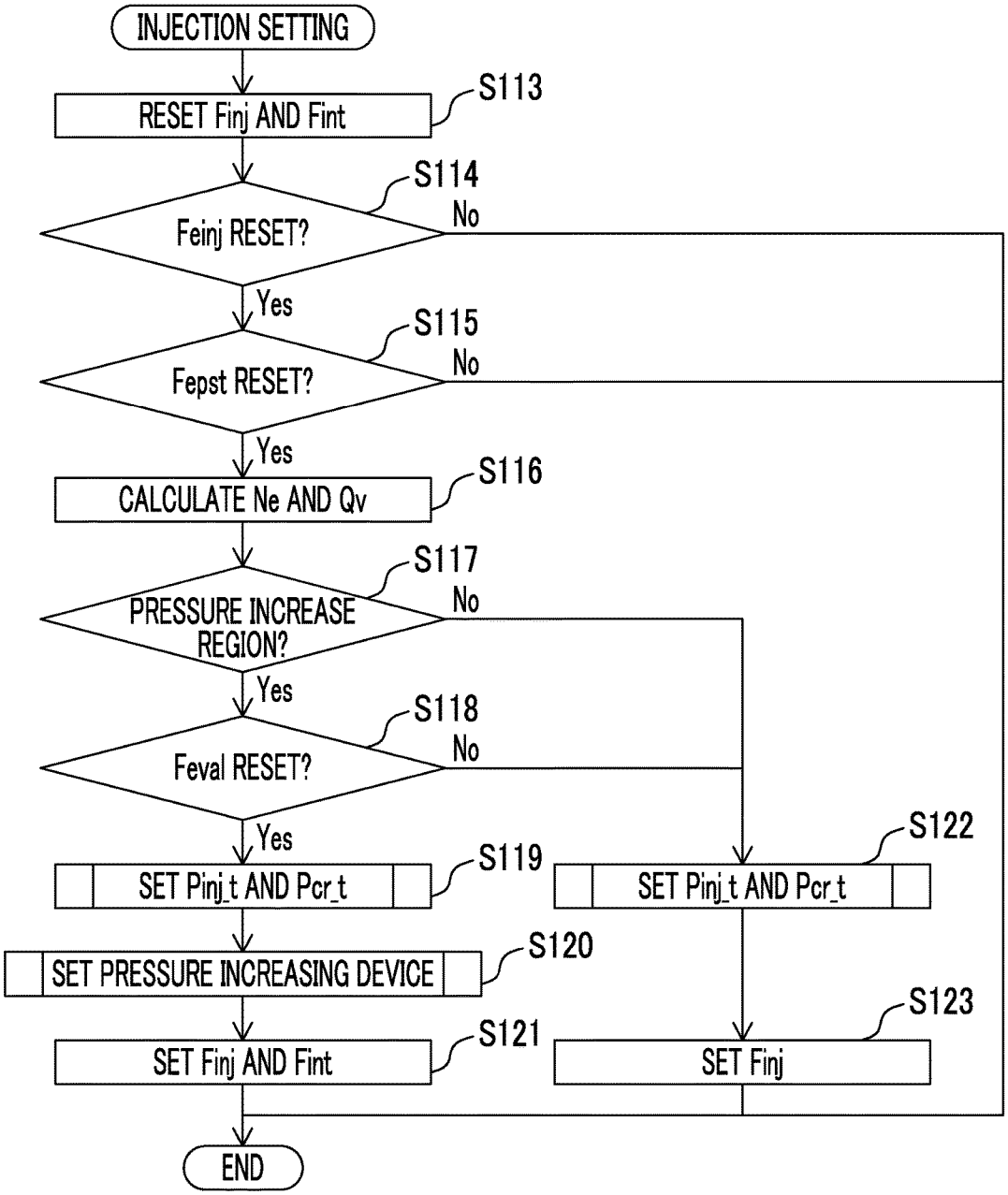
FIG. 7 is a flowchart showing a routine for setting fuel injection in the first embodiment of the present disclosure.

FIG. 7 is a flowchart showing, a routine of injection setting processing for setting fuel injection in the present embodiment. The routine of FIG. 7 is called each time step S103 in FIG. 6 is executed.

In step S113, the electronic control unit 20 resets the pressure increase permission flag Fint, which is set when the injection of fuel is allowed, and the injection permission flag Finj, which is set when the fuel pressure increase is allowed.

In step S114, the electronic control unit 20 determines whether or not an injection abnormality flag Feinj, which is set when an abnormality in the injector 9 is detected, is reset. When the injection abnormality flag Feinj is reset, the electronic control unit 20 determines that there is no abnormality in the injector 9, and proceeds to step S115. When the injection abnormality flag Feinj is set, the electronic control unit 20 determines that there is an abnormality in the injector 9, and ends the processing of this routine. That is, since the processing of this routine is ended in a state in which the injection permission flag Finj and the pressure increase permission flag Fint are reset in step S113, fuel injection and fuel pressure increase are not allowed.

In step S115, the electronic control unit 20 determines whether or not a piston abnormality flag Fepst, which is set when an abnormality is detected in a portion of the pressure increasing device 7 other than the three-way valve 77, is reset. When the piston abnormality flag Fepst is reset, the electronic control unit 20 determines that there is no abnormality in a portion of the pressure increasing device 7 other than the three-way valve 77, and proceeds to step S116 to inject fuel. When the piston abnormality flag Fepst is set, the electronic control unit 20 determines that there is an abnormality in a portion of the pressure increasing device 7 other than the three-way valve 77, and ends the processing of this routine. That is, since the processing of this routine is ended in a state in which the injection permission flag Finj and the pressure increase permission flag Fint are reset in step S113, fuel injection and fuel pressure increase are not allowed. To summarize the above, when an abnormality is detected in a portion of the pressure increasing device 7 other than the three-way valve 77 or in the injector 9, fuel injection and fuel pressure increase are not allowed.

In step S116, the electronic control unit 20 calculates the operation state of the vehicle, that is, an engine speed Ne and a request injection amount Qv. The engine speed Ne is calculated based on the rotation speed of the crankshaft detected by the crank angle sensor 16. The request injection amount Qv is calculated based on the depression amount of the accelerator pedal detected by the accelerator pedal depression amount sensor 15.

Figure 8:
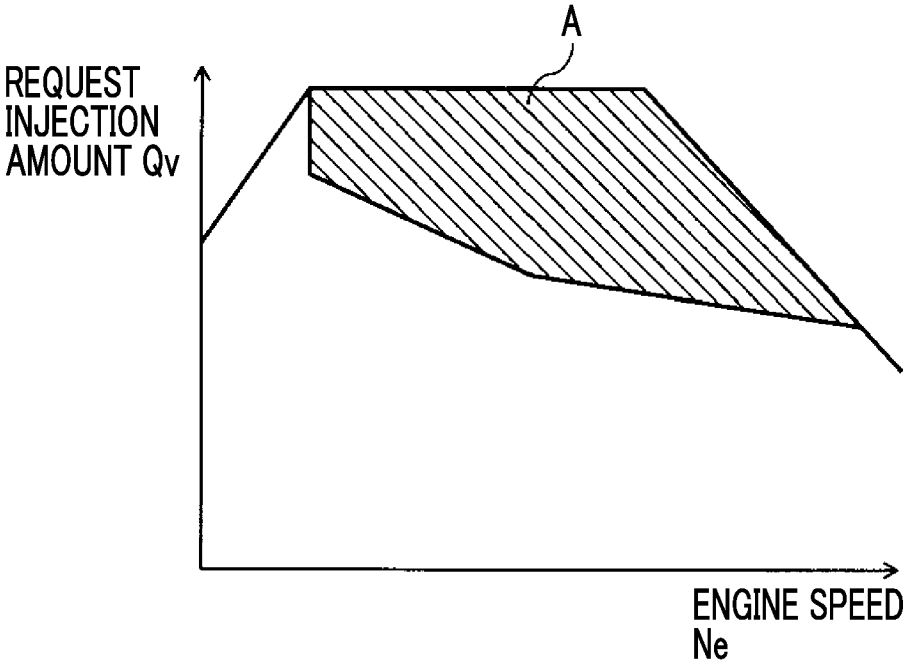
FIG. 8 is a schematic diagram of a map for determining whether or not to drive the pressure increasing device in the first and second embodiments of the present disclosure.

In step S117, the electronic control unit 20 determines whether or not to drive the pressure increasing device 7. The electronic control unit 20 stores a map in which a region for driving the pressure increasing device 7 is set corresponding to the engine speed Ne and the request injection amount Qv. FIG. 8 shows an example of a map in which a region for driving the pressure increasing device 7 is set. In the present embodiment, a map is set so as to drive the pressure increasing device 7 in a region where the amount of fuel that can be injected without driving the pressure increasing device 7 is smaller than the request injection amount Qv. In the present embodiment, the pressure increasing device 7 is driven in a case where the engine speed Ne and the request injection amount Qv are included in a region A expressed by the hatched portion in FIG. 8, and the pressure increasing device 7 is not driven in a case where the engine speed Ne and the request injection amount Qv are not included in the region A in FIG. 8. In a case where the engine speed Ne and the request injection amount Qv are included in the region A in step S117, the process proceeds to step S118 to drive the pressure increasing device 7. In a case where the engine speed Ne and the request injection amount Qv are not included in the region A in step S117, the process proceeds to step S122 to set fuel injection.

In step S118, the electronic control wait 20 determines whether or not a three-way valve abnormality flag Feval, which is set in a case where there is an abnormality in the three-way valve 77, is reset. When the electronic control unit 20 determines that the three-way valve abnormality flag Feval is reset, the process proceeds to step S119 to set fuel injection and fuel pressure increase. When the electronic control unit 20 determines that the three-way valve abnormality flag Feval is set, the electronic control unit 20 determines that the fuel pressure increase is not possible, and proceeds to step S122 to set fuel injection. In the present embodiment, when the electronic control unit 20 determines that the fuel pressure increase is not possible, the pressure increase permission flag Fint is maintained in the reset state. When the pressure increase permission flag Fint is in the reset state, step S109 is not executed. Accordingly, the pressure increase signal is not switched from OFF to ON, and the pressure increase signal remains OFF. That is, when the electronic control unit 20 determines that the three-way valve abnormality flag Feval is set in step S118, the electronic control unit 20 maintains the pressure increase signal OFF, and stops the fuel pressure increase.

In step S119, the electronic control unit 20 sets a "target injection pressure Pinj_t", which is a target value of the fuel injection pressure, and a "target common rail pressure Pcr_t", which is a target value of the common rail pressure Pcr. The target injection pressure Pinj_t and the target common rail pressure Pcr_t are determined based on the engine speed He and the request injection amount Qv calculated in step S116. In the present embodiment, in step S119, the electronic control unit 20 sets net only the fuel pressure but also the time at which the injection signal is switched from OFF to ON and the time at which the injection signal is switched from ON to OFF.

In step S120, the electronic control unit 20 sets the operation of the pressure increasing device 7. In the present embodiment, the electronic control unit 20 also sets the time at which the pressure increase signal is switched from OFF to ON and the time at which the pressure increase signal is switched from ON to OFF. After the processing of step S120 is ended, the electronic control unit 20 sets the injection permission flag Finj and the pressure increase permission flag Fint in step S121. That is, the electronic control unit 20 determines that there is no abnormality in both the pressure increasing device 7 and the injector 9, and allows the fuel injection by the injector 9 and the fuel pressure increase by the pressure increasing device 7. When the processing of step S121 is ended, the electronic control unit 20 ends the processing of this routine.

In step S122, the electronic control unit 20 sets the target injection pressure Pinj_t, which is a target value of the fuel injection pressure, and the target common rail pressure Pcr_t, which is a target value of the common rail pressure Pcr. In step S122, since the fuel pressure is not increased, the target common rail pressure Pcr_t is the same value as the target injection pressure Pinj_t. After the processing of step S122 is ended, the electronic control unit 20 sets the injection permission flag Finj while the pressure increase permission flag Fint remains reset in step S123. That is, the electronic control unit 20 allows the fuel injection by the injector 9, but does not allow the fuel pressure increase by the pressure-increasing device 7. When the processing of step S123 is ended, the electronic control unit 20 ends the processing of this routine.

To summarize the above, in the routine of FIG. 7, the electronic control unit 20 determines whether or not to inject fuel based on the injection abnormality flag Feinj, the piston abnormality flag Fepst, and the three-way valve abnormality flag Feval, and determines whether or not to increase the fuel pressure in a case where the electronic control unit 20 determines that fuel is to be injected.

Figure 9:
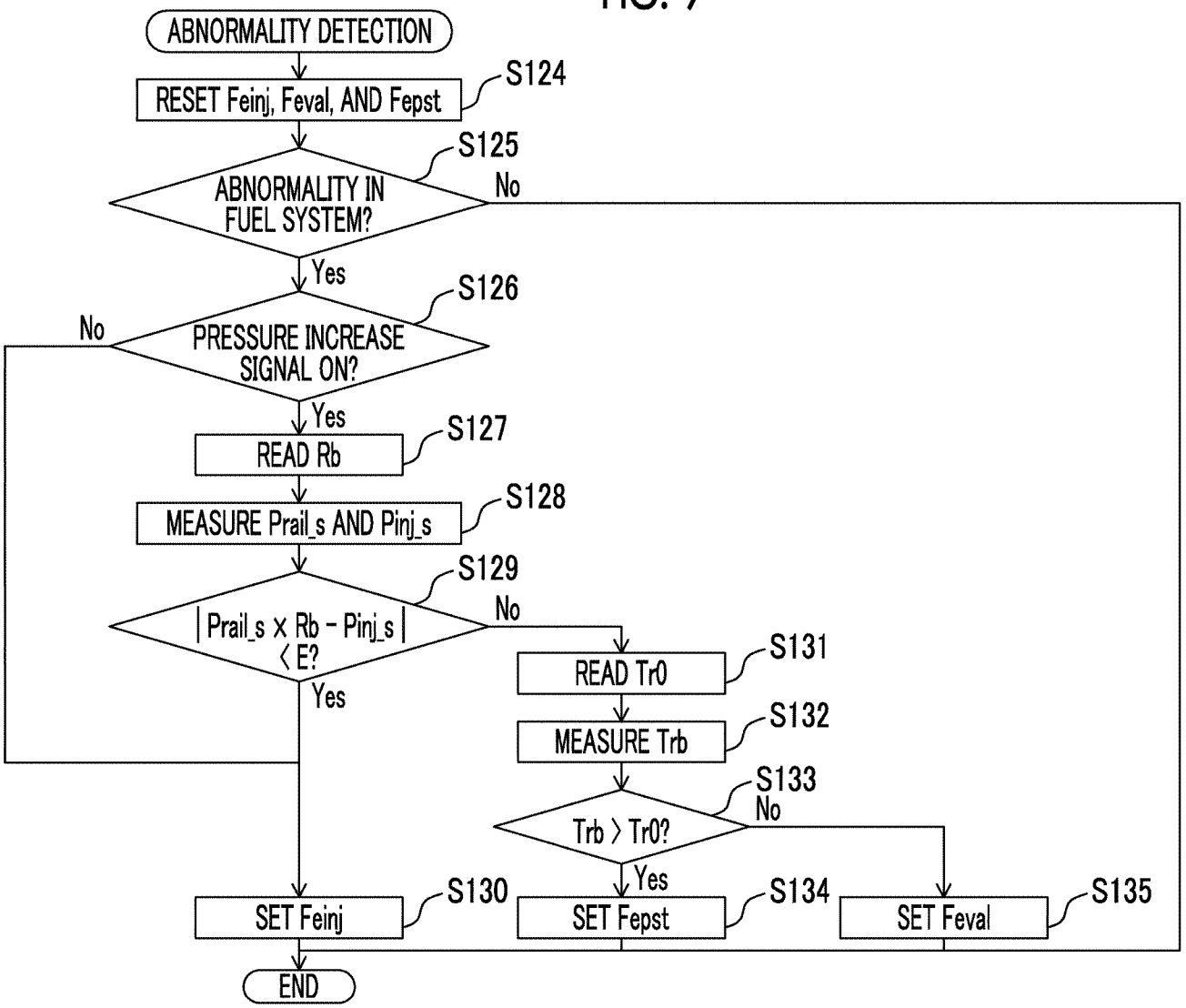
FIG. 9 is a flowchart showing a routine for detecting an abnormal portion in the first embodiment of the present disclosure.

FIG. 9 is a flowchart showing a routine of the abnormality detection processing in the present embodiment. The routine of FIG. 9 is called each time step S110 in FIG. 6 is executed.

In step S124, the electronic control unit 20 resets the injection abnormality flag Feinj that, is set when there is an abnormality in the injector 9, the three-way valve abnormality flag Feval that is set when there is an abnormality in the three-way valve 77, and the piston abnormality flag Fepst that is set when there is an abnormality in a portion of the pressure increasing device 7 other than the three-way valve 77.

In step S125, the electronic control unit 20 determines whether or not there an abnormality in either the pressure increasing device 7 or the injector 9. Hereinafter, the pressure increasing device 7 and the injector 9 will be collectively referred to as a "fuel system". That is, in step S125, the electronic control unit 29 determines whether or not there is an abnormality in the fuel system. For example, in the present embodiment, in a case where the fuel injection amount per unit time is smaller than a predetermined reference value, the electronic control unit 20 determines that there is an abnormality in either the pressure increasing device 7 or the injector 9. In a case where the electronic control unit 20 determines that there is an abnormality in the fuel system in step S125, the process proceeds to step S126. In a case where the electronic control unit 20 determines that there is no abnormality in the fuel system in step S125, this routine is ended. The abnormality of the fuel system may be determined based on the increase of combustion noise compared with the normal case, or the abnormality of the fuel system may be determined based on the lowering of fuel efficiency compared with the normal case.

In step S126, the electronic control unit 20 determines whether or not the pressure increase signal is ON. When the pressure increase signal is ON, the process proceeds to step S127 to determine whether the cause of the abnormality is the injector 9 or the pressure Increasing device 7. When the pressure increase signal is not ON, the cause of the abnormality is not the pressure increasing device 7 since the pressure increasing device 7 is not driven. Therefore, the electronic control unit 20 determines that the cause of the abnormality is the injector 9, and proceeds to step S130.

In step S127, assuming that the pressure increasing device 7 normally functions, the electronic control unit 20 reads a "record pressure increase ratio Rb" that is a ratio between the pressure of fuel discharged from the pressure increasing chamber 74 after being increased in pressure and the pressure of fuel supplied to the piston chamber 73. The record-pressure increase ratio Rb is a value experimentally obtained in advance.

In step S128, the electronic control unit 20 measures a measured value (referred to as "measured common rail pressure Prail_s") of the fuel pressure in the common rail 5 and a measured value (referred to as "measured injection pressure Pinj_s") of the fuel pressure in the injector 9. The measured common rail pressure Prail_s is detected by the common rail pressure sensor 51 provided in the common rail 5, and the measured injection pressure Pinj_s is detected by the injection pressure sensor 91 provided is the injector 9.

In step S129, the electronic control unit 20 determines whether or not there is an abnormality in the pressure increasing device 7. In the present embodiment, the electronic control unit 20 determines whether or not the absolute value of a difference between the product of the measured common rail pressure Prail_s and the record pressure increase ratio Rb and the measured injection pressure Pinj_s is smaller than a predetermined allowable threshold value E. The product of the measured common rail pressure Prail_s and the record pressure increase ratio Rb is the fuel injection pressure Pinj when the pressure increasing device 7 normally functions. Therefore, in a case where the measured injection pressure Pinj_s is almost the same as the fuel injection pressure Pinj in a case where the pressure increasing device 7 normally functions, the electronic control unit 20 can determine that the pressure increasing device 7 is normal. Therefore, in a case where the absolute value of the difference between the product of the measured common rail pressure Prail_s and the record pressure increase ratio Rb and the measured injection pressure Pinj_s is smaller than the predetermined allowable threshold value E, the electronic control unit 20 determines that there is no abnormality in the pressure increasing device 7 and there is an abnormality in the injector 9, and proceeds to step S130. On the other hand, in a case where the absolute value of the difference between the product of the measured common rail pressure Prail_s and the record pressure increase ratio Rb and the measured injection pressure Pinj_s is equal to or greater than the predetermined allowable threshold-value E, the electronic control unit 20 determines that there is an abnormality in the pressure increasing device 7, and proceeds to step S131.

In step S130, the electronic control unit 20 sets the injection abnormality flag Feinj that is set when there is an abnormality in the injector 9. When the processing of step S130 is ended, the electronic control unit 20 ends this routine, proceeds to step S111 in FIG. 6, and ends the routine of FIG. 6. In the present embodiment, when the injection abnormality flag Feinj is set, the electronic control unit 20 calls step S103 in FIG. 6, and performs setting so as not to inject fuel at the time of the processing of step S114 in FIG. 7.

In step S131, the electronic control unit 20 reads a pre-injection return temperature Tr0 stored, in step S104 in FIG. 6. Then, in step S132, the electronic control unit 20 measures an "injection return temperature Trb" that is the temperature of fuel flowing through the return passage 10. In the present embodiment, the injection return temperature Trb is the temperature measured by the return passage temperature sensor 101.

In step S133, in order to determine whether or not there is an abnormality in the three-way valve 77, the electronic control unit 20 determines whether or not the injection return temperature Trb is higher than the pre-injection return temperature Tr0. In a case where the injection return temperature Trb is higher than the pre-injection return temperature Tr0, as a result of normal functioning of the three-way valve 77, the electronic control unit 20 can determine that the fuel flows from the pressure increase control chamber 75 to the return passage 10 when tire pressure increase signal is switched from OFF to ON. In a case where the injection return temperature Trb is higher than the pre-injection return temperature Tr0 in step S133, the electronic control unit 20 determines that the three-way valve 77 is normal, and proceeds to step S134. In a case where the injection return temperature Trb is equal to or lower than the pre-injection return temperature Tr0 in step S133, the electronic control unit 20 determines that there is an abnormality in the three-way valve 77, and proceeds to step S135.

In step S134, the electronic control unit 20 sets the piston abnormality flag Fepst, which is set when there is an abnormality in a portion of the pressure increasing device 7 other than the three-way valve 77, and ends the processing of this routine. When the processing of this routine is ended, the electronic control unit 20 proceeds to step S111 in FIG. 6, and ends the routine of FIG. 6. In the present embodiment, when the piston abnormality flag Fepst is set the electronic control unit 20 calls step S103 in FIG. 6, and performs setting so as not to inject fuel at the time of the processing of step S115 in FIG. 7.

In step S135, the electronic control unit 20 sets the three-way valve abnormality flag Feval, which is set when there is an abnormality in the three-way valve 77, and ends the processing of this routine. When the processing of this routine is ended, the electronic control unit 20 proceeds to step S111 in FIG. 6, and ends the routine of FIG. 6. In the present embodiment, when the three-way valve abnormality flag Feval is set, the electronic control unit 20 calls step S103 in FIG. 6, and performs setting such that the fuel is injected but the fuel pressure is not increased at the time of the processing of step S118 in FIG. 7. That is, the fuel pressure increase by the pressure increasing device 7 is stopped.

As described above, the control device for an internal combustion engine includes: the fuel tank 1; the common rail 5 (high pressure fuel passage) through which fuel, which is supplied from the fuel tank 1 and is increased in pressure by the supply pump 3, flows; the pressure increasing device 7 for increasing the pressure of the fuel supplied from the common rail 5 (high pressure fuel passage); the three-way valve 77 (switching device) for driving the pressure increasing device 7 by switching the connection state of the pressure increasing device 7 between a first connection state in which the pressure increasing device 7 and the common rail 5 (high pressure fuel passage) are connected to each other and a second connection state in which the pressure increasing device 7 and the fuel tank 1 are connected to each other; the return passage 10 (low pressure fuel passage) through which fuel, which returns to the fuel tank 1 without being increased in pressure by the pressure increasing device 7, flows; the return passage temperature sensor 101 (temperature sensor) for measuring the temperature of the fuel flowing through the return passage 10 (low pressure fuel passage); the injector 9 (fuel injector) for injecting the fuel having a pressure that has been increased by the pressure increasing device 7; and the electronic control unit 20. The electronic control unit 20 executes steps S109, S117, and S118 in which whether or not to increase the fuel pressure is determined based on the engine operation state and the fuel pressure is increased by switching the pressure increase signal from OFF to ON (outputting the pressure increase signal for switching the connection state to the second connection state) when determination that the fuel pressure is to be increased is made, and step S133 for specifying whether or not there is an abnormality in the three-way valve 77 (switching device). In step S133, in a case where the injection return temperature Trb (temperature measured by the temperature sensor) when the pressure increase signal is switched from OFF to ON (when the signal for increasing the fuel pressure is output) in step S109 is not higher than the pre-injection return temperature Tr0 (temperature measured by the temperature sensor) when the pressure increase signal is switched from ON to OFF (when the pressure increase signal is not output) in step S109, the electronic control unit 20 determines that there is an abnormality in the three-way valve 77 (switching device). In step S108, when the electronic control unit 20 determines that the three-way valve abnormality flag Feval is set in step S118 (when the electronic control unit 20 determines that there is an abnormality in the three-way valve 11 (switching device) in step S133), the pressure increase permission flag Fint is not set regardless of the engine operation state, so that the pressure increase signal is maintained OFF (output of the pressure increase signal is stopped) to stop the fuel pressure increase by the pressure increasing device 1. According to the embodiment described above, when the three-way valve 77 is normally operating, the temperature measured by the return passage temperature sensor 101 rises as the fuel in the pressure increase control chamber 75 is discharged to the return passage 10. Therefore, the electronic control unit 20 can determine whether or not there is an abnormality in the three-way valve 77 based on the temperature of the return passage temperature sensor 101.

The electronic control unit 20 executes step S129 for detecting whether or not there is an abnormality in the pressure increasing device 7. When the electronic control unit 20 determines that there is an abnormality in the pressure increasing device 7 in step S129 and there is an abnormality in the three-way valve 77 (switching device) in step S133, fuel is injected by the injector 9 (fuel injector). On the other hand, when the electronic control unit 20 determines that there is an abnormality in the pressure increasing device 7. In step S129 and there is no abnormality in the three-way valve 77 (switching device) in step S133, the fuel injection by the injector 9 (fuel injector) is stopped. According to the embodiment described above, in a case where there is no need to stop the fuel injection even if there is an abnormality in the three-way valve 77, the electronic control unit 20 continues the fuel injection. Therefore, since there is no constraint on the operation of the internal combustion engine due to the stop of fuel injection, the controllability is further improved.

The internal combustion engine 100 includes the common rail pressure sensor 51 (rail pressure sensor) for measuring the fuel pressure of the common rail 5 (high pressure fuel passage) and the injection pressure sensor 91 for measuring the fuel pressure of the injector 9 (fuel injector). The electronic control unit 20 includes a storage unit that stores the record pressure increase ratio Rb (pressure increase ratio) of the pressure increasing device 7. In step S129, in a case where the electronic control unit 20 determines that the absolute value of the difference between the product of the measured common rail pressure Prail_s (fuel pressure measured by the rail pressure sensor) and the record pressure increase ratio Rb (pressure increase ratio) and the measured injection pressure Pinj_s (fuel pressure measured by the injection pressure sensor) is equal to or greater than the allowable threshold value E (predetermined difference), the electronic control unit 20 determines that there is an abnormality in the pressure increasing device 7. According to the first embodiment described above, an abnormality in the pressure increasing device 7 can be accurately detected without adding a sensor by using the standard common rail pressure sensor 51 and the standard injection pressure sensor 91.

The electronic control unit 20 executes step S125 for detecting whether or not there is an abnormality in at least one of the pressure increasing device 7 and the injector 9 (fuel injector). Solely in a case where the electronic control unit 20 detects that there is an abnormality in at least one of the pressure increasing device 7 and the injector 9 in step S125, the electronic control unit 20 determines whether or not there is an abnormality in the three-way valve 77 (switching device) in step S133. According to the first embodiment described above, since the frequency of executing step S133 is reduced, the control can be simplified.

Second Embodiment

A routine for detecting an abnormality in the three-way valve 77 in a second embodiment of the present disclosure will be described. The routine of the second embodiment of the present disclosure includes a routine relevant to the fuel injection described in FIG. 6, a routine relevant to the fuel injection setting described in FIG. 10, and a routine relevant to the abnormality detection described in FIG. 11.

In the first embodiment the electronic control unit 20 determines whether or not there is an abnormality in the fuel system in step S125 in FIG. 9 and then determines whether or not there is an abnormality in the three-way valve 77 in step S133. On the other hand, the second embodiment is different from the first embodiment in that the electronic control unit 20 determines whether or not there is an abnormality in the fuel system after determining whether or not there is an abnormality in the three-way valve 77 in step S133 in FIG. 11. In the first embodiment, by determining whether or not there is an abnormality in the three-way valve 77 after determining whether or not there is an abnormality in the pressure increasing device 7, whether or not there is an abnormality in a portion of the pressure increasing device 7 other than the three-way valve 77 is determined. On the other hand, the second embodiment is different from the first embodiment in that the electronic control unit 20 determines merely whether or not there is an abnormality in the fuel system without determining whether or not there is an abnormality in a portion of the pressure increasing device 7 other than the three-way valve 77. Hereinafter, solely the differences from the first embodiment will be described, and the repeated description will be omitted.

Figure 10:
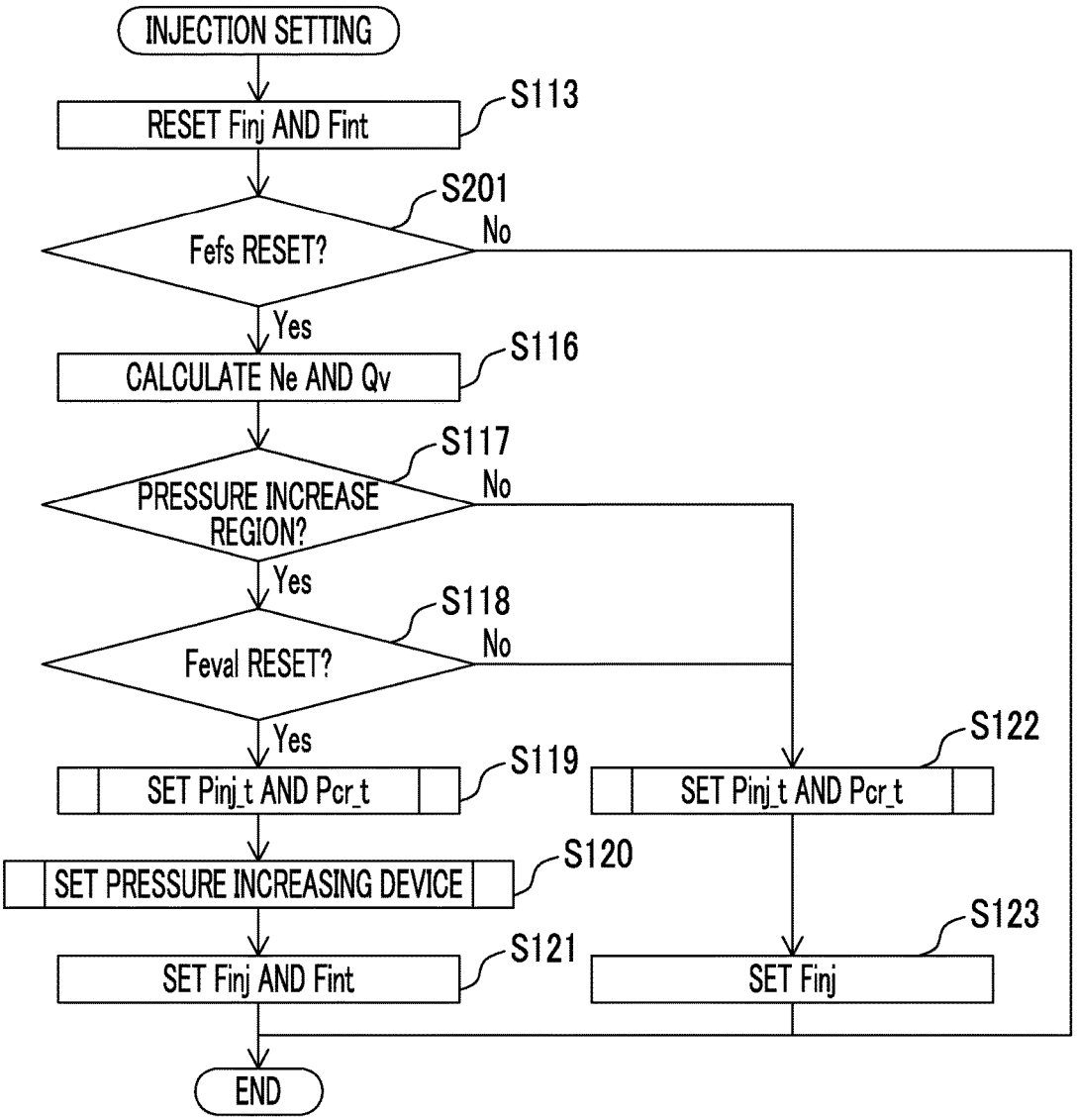
FIG. 10 is a flowchart showing a routine for setting fuel injection in the second embodiment of the present disclosure.
Figure 11:
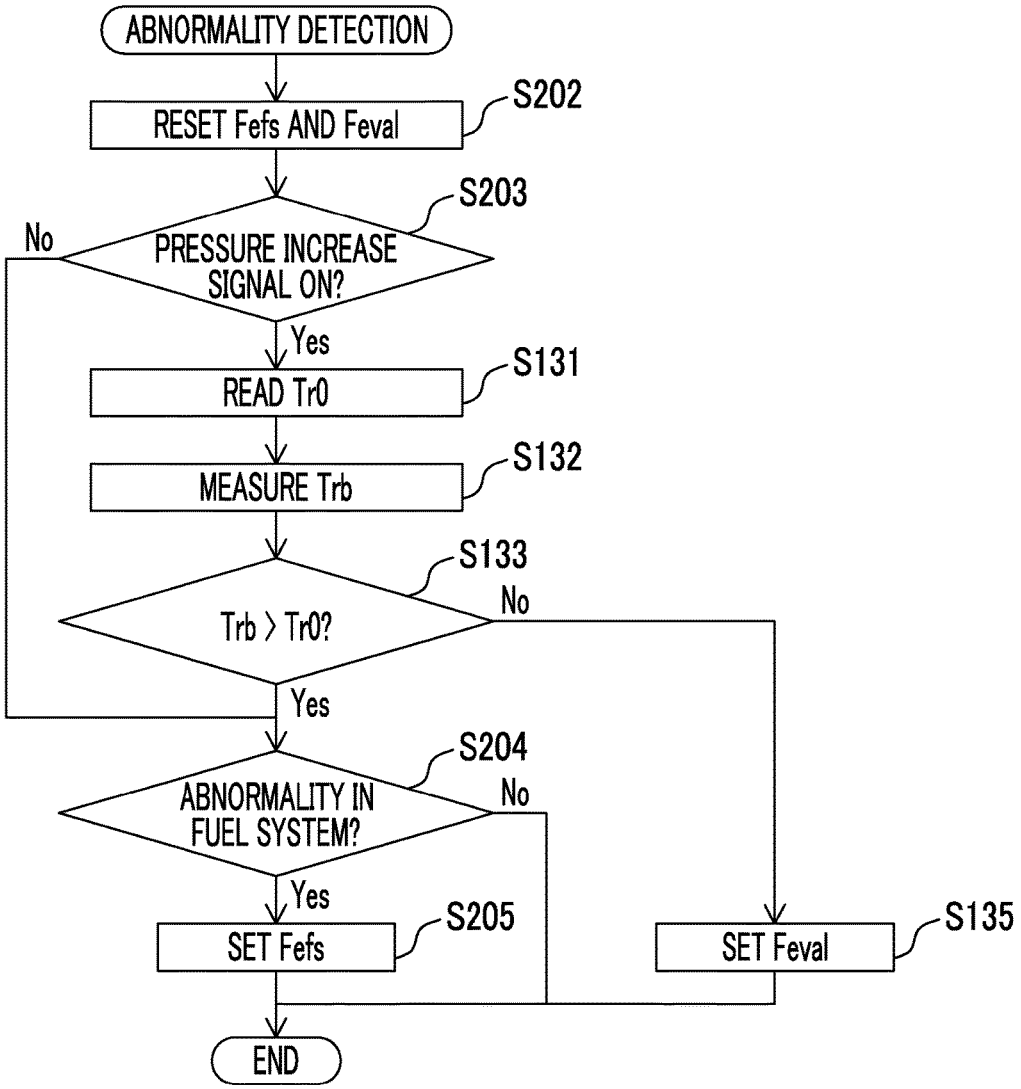
FIG. 11 is a flowchart showing a routine for detecting an abnormal portion m the second embodiment of the present disclosure.

FIG. 6 is a flowchart showing a routine of fuel injection control in the second embodiment. In the first embodiment, the routine of FIG. 7 is executed in step S103 in FIG. 6. In the second embodiment, however, the routine of FIG. 10 is executed in step S103. In the first embodiment, the routine of FIG. 9 is executed in step S110 in FIG. 6. In the second embodiment, however, the routine of FIG. 11 is executed in step S110. Since other points are the same as those in the first and second embodiments, the description will be omitted.

FIG. 10 is a flowchart showing a routine of injection setting processing for setting fuel injection in the second embodiment. The routine of FIG. 10 is called each time step S103 is executed.

In step S113, the electronic control unit 20 resets the injection permission flag Finj and the pressure increase permission flag Fint. Then, in step S201, the electronic control unit 20 determines whether or not a "system abnormality flag Fefs", which is set in a case where there is no abnormality in the three-way valve 77 and there is an abnormality in the pressure increasing device 7 or the injector 9, is reset. The case where the system abnormality flag Fefs is reset is a case where there is no abnormality in the three-way valve 77 and there is an abnormality in the pressure increasing device 7 or the injector 9.

As the case where them is no abnormality in the three-way valve 77 and there is an abnormality in the pressure increasing device 7, a case is assumed where foreign matter is caught between the piston 72 and the housing 71 as described above. Therefore, this is a case where fuel should not be supplied to the injector 9. On the other hand, even in a case where there is an abnormality in the injector 9, fuel should not be supplied to the injector 9. That is, since the case where the system abnormality flag Fefs is set is a case where fuel should not be supplied to the injector 9, the electronic control unit 20 ends this routine without setting the injection permission flag Finj in a case where the electronic control unit 20 that the system abnormality flag Fefs is not reset in step S201. As a result, no fuel is injected from, the injector 9.

In a case where the electronic control unit 20 determines that the system abnormality flag Fefs is reset in step S201, the process proceeds to step S116 to set the fuel injection. Since the control from step S116 is the same as that in the first embodiment, the description will be omitted.

FIG. 11 is a flowchart showing a routine for detecting an abnormality in the second embodiment of the present disclosure. The routine of FIG. 11 is called each time step S110 is executed.

In step S202, the system abnormality flag Fefs, which is set in a case where there is no abnormality in the three-way valve 77 and there is an abnormality in the pressure increasing device 7 or the injector 9, and the three-way valve abnormality flag Feval, which is set in a case where there is an abnormality in the three-way valve 77, are reset.

In step S203, the electronic, control unit 20 determines whether or not the pressure increase signal is ON. In a case where the electronic control unit 20 determines that the pressure increase signal is ON, the process proceeds to step S131 to determine whether or not there is as abnormality in the three-way valve 77. In a case where the electronic control unit 20 determines that the pressure increase signal is not ON, the process proceeds to step S204 to determine whether or not there is an abnormality in the fuel system.

In steps S131 to S133, the electronic control unit 20 determines whether or not there is an abnormality in the three-way valve 77 as in the first embodiment. In a case where the electronic control unit 20 determines that the injection return temperature Trb is higher than the pre-injection return temperature Tr0, that is, the three-way valve 77 is normal in step S133, the process proceeds to step S204 to determine whether or not there is an abnormality in the fuel system. On the other hand, in a case where the electronic control unit 20 determines that the injection return temperature Trb is equal to or lower than the pre-injection return temperature Tr0, that is, there is an abnormality in the three-way valve 77 in step S133, the electronic control unit 20 proceeds to step S135 to set the three-way valve abnormality flag Feval, and ends this routine.

In step S204, the electronic control unit 20 determines whether or not there is an abnormality in the fuel system, that is, there is an abnormality in either the pressure increasing device 7 or the injector 9. In step S204, the electronic control unit 20 performs the same processing as step S125. In a case where the electronic control unit 20 determines that there is an abnormality in step S204, the electronic control unit 20 sets the system abnormality flag Fefs in step S205 without determining whether there is an abnormality in the three-way valve 77 or there is an abnormality in the injector 9, and ends this routine. On the other hand, in a case where the electronic control unit 20 determines that there is no abnormality in step S204, the electronic control unit 20 ends this routine.

As described above, the electronic control unit 20 executes step S204 for detecting whether or not there is an abnormality in at least one of the pressure increasing device 7 and the injector 9, and the fuel pressure increase by the pressure increasing device 7 is stopped when the electronic control unit 20 determines that there is an abnormality in the three-way valve 77 (switching device) in step S133. When the electronic control unit 20 determines that there is m abnormality in the three-way valve 77 (switching device) in step S133 and there is an abnormality in at least one of the pressure increasing device 7 and the injector 9 (fuel injector) in step S204, the fuel injection by the injector 9 (fuel injector) is stopped. According to the second embodiment described above, since an abnormality in the three-way valve 77 can be detected without specifying whether or not the cause of the abnormality is the injector 9, the control can be simplified.

What is claimed is:

1. A control device for an internal combustion engine, the control device comprising:

a fuel tank;

a high pressure fuel passage through which fuel flows, the fuel being supplied from the fuel tank and having a pressure increased by a supply pump;

a pressure increasing device that includes a piston configured to increase the pressure of fuel supplied from the high pressure fuel passage;

a switching device that includes a valve configured to switch a state of connection with the pressure increasing device between a first connection state, in which the pressure increasing device and the high pressure fuel passage are connected to each other, and a second connection state, in which the pressure increasing device and the fuel tank are connected to each other, to drive the pressure increasing device;

a low pressure fuel passage through which fuel, which returns to the fuel tank without being increased in pressure by the pressure increasing device, flows when the connection state is switched to the second connection state and the pressure of fuel is increased by the pressure increasing device;

a temperature sensor configured to measure a temperature of fuel flowing through the low pressure fuel passage;

a fuel injector configured to inject fuel having the pressure increased by the pressure increasing device; and an electronic control unit configured to determine to increase the pressure of fuel based on an operation state of the internal combustion engine, the electric control unit being configured to increase the pressure of fuel by outputting a pressure increase signal for switching the connection state to the second connection state, when the electronic control unit determines that the pressure of fuel is to be increased, wherein:

the electronic control unit is configured to determine that there is an abnormality in the switching device when a temperature measured by the temperature sensor when the pressure increase signal is output is not higher than a temperature measured by the temperature sensor when the pressure increase signal is not output; and the electronic control unit is configured to stop fuel pressure increase performed by the pressure increasing device by stopping an output of the pressure increase signal regardless of the operation state of the internal combustion engine when the electronic control unit determines that there is the abnormality in the switching device.

2. The control device according to claim 1, wherein:

the electronic control unit is configured to determine whether there is an abnormality in the pressure increasing device;

the electronic control unit is configured to control the fuel injector to inject the fuel when the electronic control unit determines that there is the abnormality in the pressure increasing device and there is the abnormality in the switching device; and the electronic control unit is configured to control the fuel injector to stop injecting the fuel when the electronic control unit determines that there is the abnormality in the pressure increasing device and there is no abnormality in the switching device.

3. The control device according to claim 2, wherein:

the internal combustion engine includes a rail pressure sensor configured to measure the pressure of the fuel which flows through the high pressure fuel passage and an injection pressure sensor configured to measure the pressure of the fuel in the fuel injector;

the electronic control unit includes a storage unit configured to store a pressure increase ratio of the pressure increasing device; and the electronic control unit is configured to determine that there is the abnormality in the pressure increasing device when the electronic control unit determines that an absolute value of a difference between a product of the fuel pressure measured by the rail pressure sensor and the pressure increase ratio and the fuel pressure measured by the injection pressure sensor is equal to or greater than a predetermined difference.

4. The control device according to claim 1, wherein:

the electronic control unit is configured to determine whether there is the abnormality in at least one of the pressure increasing device and the fuel injector; and the electronic control unit is configured to determine whether or not there is the abnormality in the switching device when the electronic control unit detects that there is the abnormality in at least one of the pressure increasing device and the fuel injector.

5. The control device according to claim 1, wherein:

the electronic control unit is configured to determine whether there is an abnormality in at least one of the pressure increasing device and the fuel injector;

the electronic control unit is configured to stop fuel pressure increase performed by the pressure increasing device when the electronic control unit determines that there is the abnormality in the switching device; and the electronic control unit is configured to control the fuel injector to stop injecting the fuel when the electronic control unit determines that there is no abnormality in the switching device and there is the abnormality in at least one of the pressure increasing device and the fuel injector.

* * * * *